US006839918B1

(12) United States Patent
Jensen

(10) Patent No.: US 6,839,918 B1
(45) Date of Patent: Jan. 11, 2005

(54) COLLAPSIBLE WHEEL CHAIR WITH DISPLACEABLE SEAT PANELS

(75) Inventor: Neil B. Jensen, Nashotah, WI (US)

(73) Assignee: Ronald J. Jensen, Moraga, CA (US)

( * ) Notice: Subject to any disclaimer, the term of this patent is extended or adjusted under 35 U.S.C. 154(b) by 0 days.

(21) Appl. No.: 10/630,611

(22) Filed: Jul. 30, 2003

(51) Int. Cl.[7] ..... A47C 4/04

(52) U.S. Cl. ..... 4/480; 4/483; 297/42; 297/DIG. 4; 280/647

(58) Field of Search ..... 4/478–480, 483; 297/42, 118, DIG. 4; 280/250.1, 304.1, 42, 647, 648, 650

(56) References Cited

U.S. PATENT DOCUMENTS 4,007,959 A * 2/1977 Juergens ..... 297/42

4,514,867 A 5/1985 Jensen ..... 4/480

* cited by examiner

*Primary Examiner*—Gregory L. Huson
*Assistant Examiner*—Peter deVore
(74) *Attorney, Agent, or Firm*—Donald J. Ersler

(57) ABSTRACT

A collapsible wheel chair with displaceable seat panels includes a first side frame member, a second side frame member, a seat frame, a first pivoting support member, a second pivoting support member, a first pair of wheels and a second pair of wheels. The first side frame member is retained relative to the second side frame member with the first and second pivoting members. One side of the seat frame is pivotally attached to one of the side frame members. The seat frame includes at least one seat section, which may each be independently raised or lower on one end thereof. The first pair of wheels are pivotally retained by the first and second side frame members. The second pair of wheels are pivotally retained by the first and second side frame members.

20 Claims, 9 Drawing Sheets

COLLAPSIBLE WHEEL CHAIR WITH DISPLACEABLE SEAT PANELS

BACKGROUND OF THE INVENTION

1. Field of the Invention

The present invention relates generally to wheel chairs and more specifically to a collapsible wheel chair with displaceable seat panels, which may be wheeled over a toilet, while the occupant remains in the wheel chair.

2. Discussion of the Prior Art

The prior art provides numerous designs of collapsible wheel chairs. However, it appears that none of these collapsible wheel chairs are capable of being wheeled over a toilet, while the occupant remains in the wheel chair. The support mechanisms of the prior art collapsible wheel chairs prevent them from being wheeled over a toilet. U.S. Pat. No. 4,514,867 to Jensen discloses a wheel chair with displaceable seat panel. The wheel chair with displaceable seat panel may be rolled over a toilet for use by the occupant of the wheel chair. However, the Jensen wheel chair is not collapsible.

Accordingly, there is a clearly felt need in the art for a collapsible wheel chair with displaceable seat panels, which may be wheeled over a toilet, may be collapsed and includes the ability to independently raise or lower each one of the seat panels.

SUMMARY OF THE INVENTION

The present invention provides a collapsible wheel chair with displaceable seat panels, which may be wheeled over a toilet and may be collapsed for transportation and storage. The collapsible wheel chair with displaceable seat panels (collapsible wheel chair) includes a first side frame member, a second side frame member, a seat frame, a first pivoting support member, a second pivoting support member, a first pair of wheels and a second pair of wheels.

The first pivoting support member includes a first pivoting member and a second pivoting member pivotally attached to the first pivoting member. The second pivoting support member includes a first pivoting member and a second pivoting member pivotally attached to the first pivoting member. The first side frame member is retained relative to the second side frame member by pivotally attaching one end of the first pivoting support member to a front of the first side frame member and the other end of the first pivoting support member is pivotally attached to a front of the second side frame member. One end of the second pivoting support member is attached to a rear of the first side frame member and the other end of the second pivoting support member is attached to a rear of the second side frame member.

One side of the seat frame is pivotally attached to one of the side frame members. One end of at least two pivotal links are pivotally attached to the other side frame member. The other end of the at least two pivotal links are pivotally attached to substantially a middle of the seat frame. The seat frame includes at least one seat panel, which may each be independently raised or lower on one end thereof. Preferably, one end of a resilient seat back is retained by one side frame member and the other end of the resilient seat back is retained by the other side frame member.

One of a first pair of wheels is pivotally retained by the first side frame member at a rear thereof and the other one of the first pair of wheels is pivotally retained by the second side frame member at a rear thereof. One of a second pair of wheels is attached to a front of the first side frame member and the other one of the second pair of wheels is attached to a front of the second side frame member. A first foot rest assembly extends from a front of the first side frame member and a second foot rest assembly extends from a front of the second side frame member.

The collapsible wheel chair is placed in a collapsed orientation by lifting one side of the seat frame upward, which causes the first side frame member to move toward the second side frame member.

Accordingly, it is an object of the present invention to provide a collapsible wheel chair that may be wheeled over a toilet for use by the occupant, while sitting in the chair.

Finally, it is another object of the present invention to provide a collapsible wheel chair that has at least one seat panel, which may be individually raised or lowered to alleviate sores to the posterior of a user.

These and additional objects, advantages, features and benefits of the present invention will become apparent from the following specification.

DETAILED DESCRIPTION OF THE PREFERRED EMBODIMENTS

Figure 1:
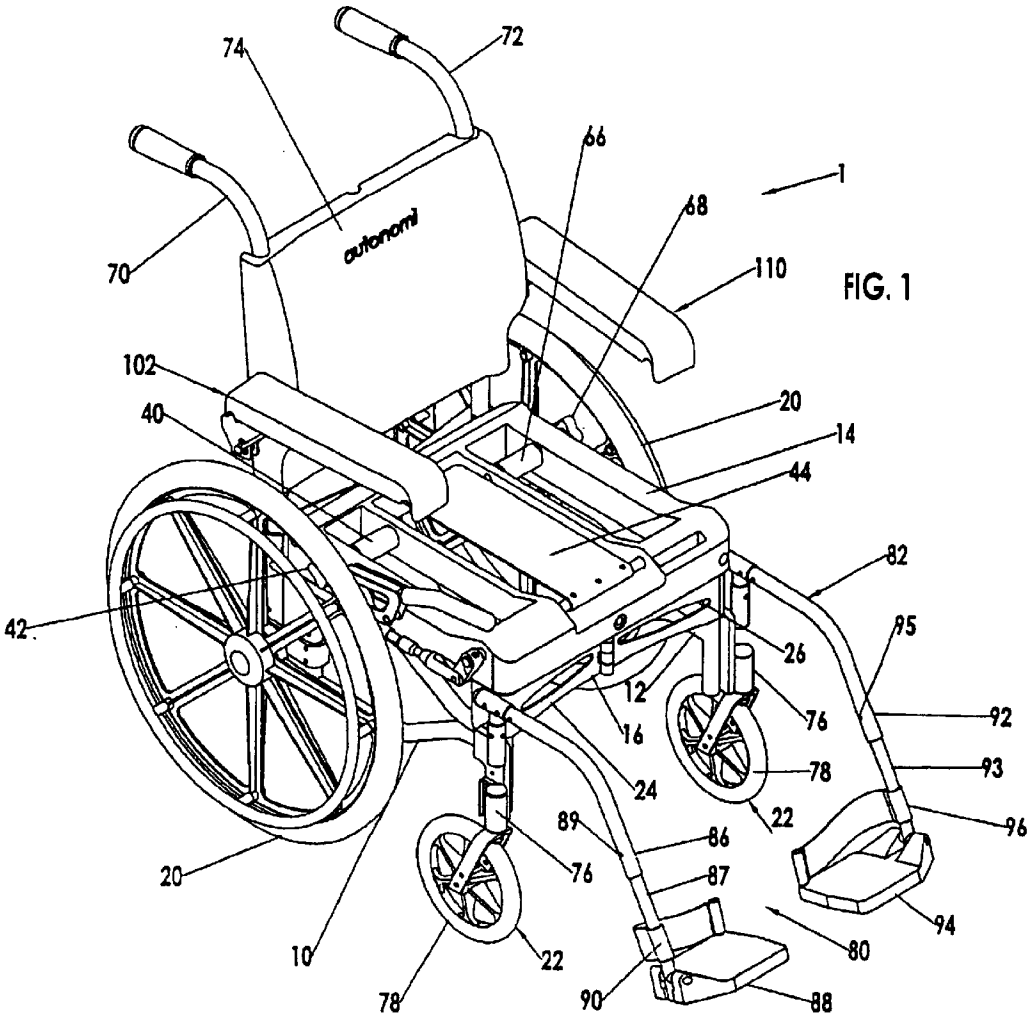
FIG. 1 is a perspective view of a collapsible wheel chair with seat panel cushions removed in accordance with the present invention.

With reference now to the drawings, and particularly to FIG. 1, there is shown a perspective view of a collapsible wheel chair 1. With reference to FIGS. 1*a*–4, the collapsible wheel chair 1 includes a first side frame member 10, a second side frame member 12, a seat frame 14, a first pivoting support member 16, a second pivoting support member 18, a first pair of wheels 20 and a second pair of wheels 22.

The first pivoting support member 16 includes a first pivoting member 24 and a second pivoting member 26 pivotally attached to the first pivoting member 24. The second pivoting support member 18 includes a first pivoting member 28 and a second pivoting member 30 is pivotally attached to the first pivoting member 28. The first side frame member 10 is retained relative to the second side frame member 12 by pivotally attaching one end of the first pivoting support member 16 to a front of the first side frame member 10 and the other end of the first pivoting support member 10 is pivotally attached to a front of the second side frame member 12. One end of the second pivoting support member 18 is attached to a rear of the first side frame member 10 and the other end of the second pivoting support member 18 is pivotally attached to a rear of the second side frame member 12.

Figure 5:
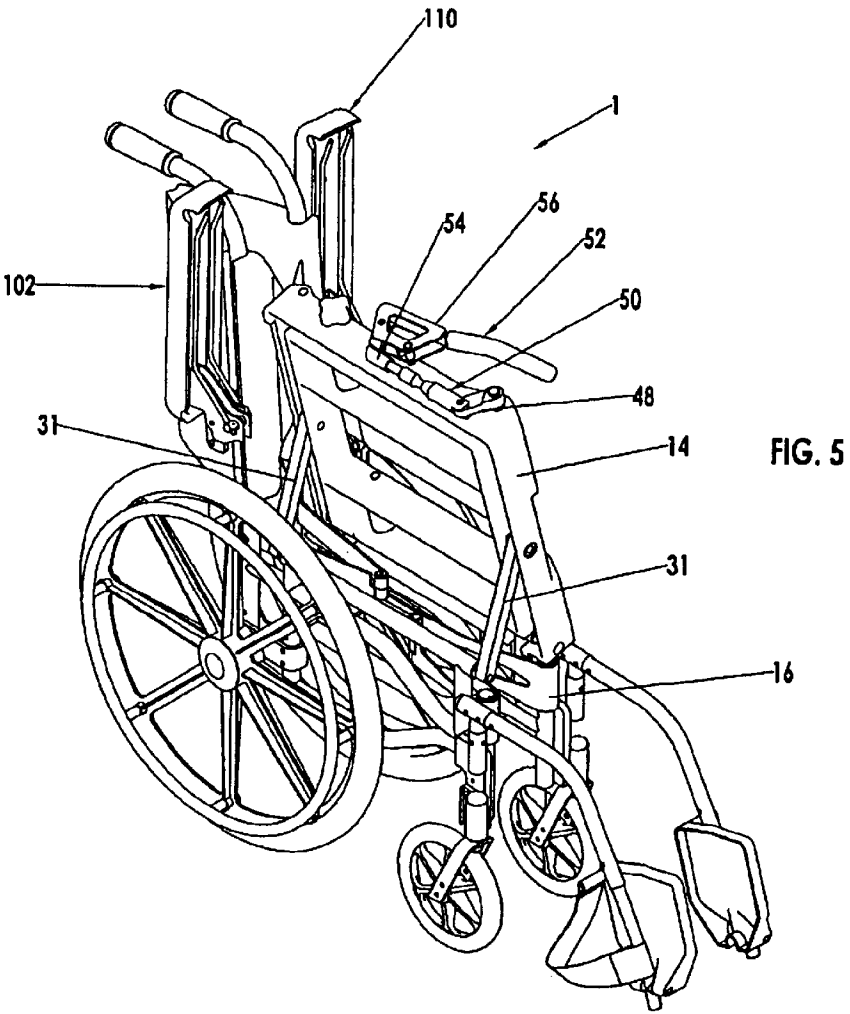
FIG. 5 is a perspective view of a collapsible wheel chair in a collapsed orientation in accordance with the present invention.

One side of the seat frame 14 is pivotally attached to one of the side frame members. With reference to FIG. 5, one end of at least two pivotal links 31 are pivotally to the other side frame member. The other end of the at least two pivotal links 31 are pivotally attached to substantially a middle of the seat frame 14. The seat frame 14 preferably includes a first seat opening 32, a center seat opening 34 and a second seat opening 36. A first seat panel 38 is pivotally retained in the first seat opening 32 at a front thereof. The height of the rear of the first seat panel 38 is controlled by rotation of a first cam roller 40 pivotally retained in a rear of the first seat opening 32. The first cam roller 40 may be rotated by a first knob 42 or with a motor.

One end of a center seat panel 44 is rigidly attached to a pivot rod 46 and the pivot rod 46 is pivotally retained in the seat frame 14 at a front thereof. One end of a leg extension 48 is rigidly attached to an end of the pivot rod 46. The pivot rod 46 also acts as a torsion bar, the center of the pivot rod 46 will rotate relative to the leg extension 48. One end of a turnbuckle 50 is pivotally attached to the other end of the leg extension 48. A handle 52 includes a base 54 and a handle portion 56. The handle portion 56 extends from the base 54. One end of the base 54 is pivotally attached to a first side of the seat frame 14.

The turnbuckle 50 includes a first pivotal member 58, an adjustment member 60 and a second pivotal member 62. One end of the first pivotal member 58 is pivotally attached to the leg extension 48 and the other end is threadably engaged with one end of the adjustment member 60. One end of the second pivotal member 62 is pivotally attached to the other end of the base 54 and the other end is threadably engaged with the other end of the adjustment member 60. Rotating the adjustment member 60 adjusts the height of the center seat panel 44 at a rear thereof. The adjustment member 60 is not disclosed in the Jensen '867 patent.

Figure 1A:
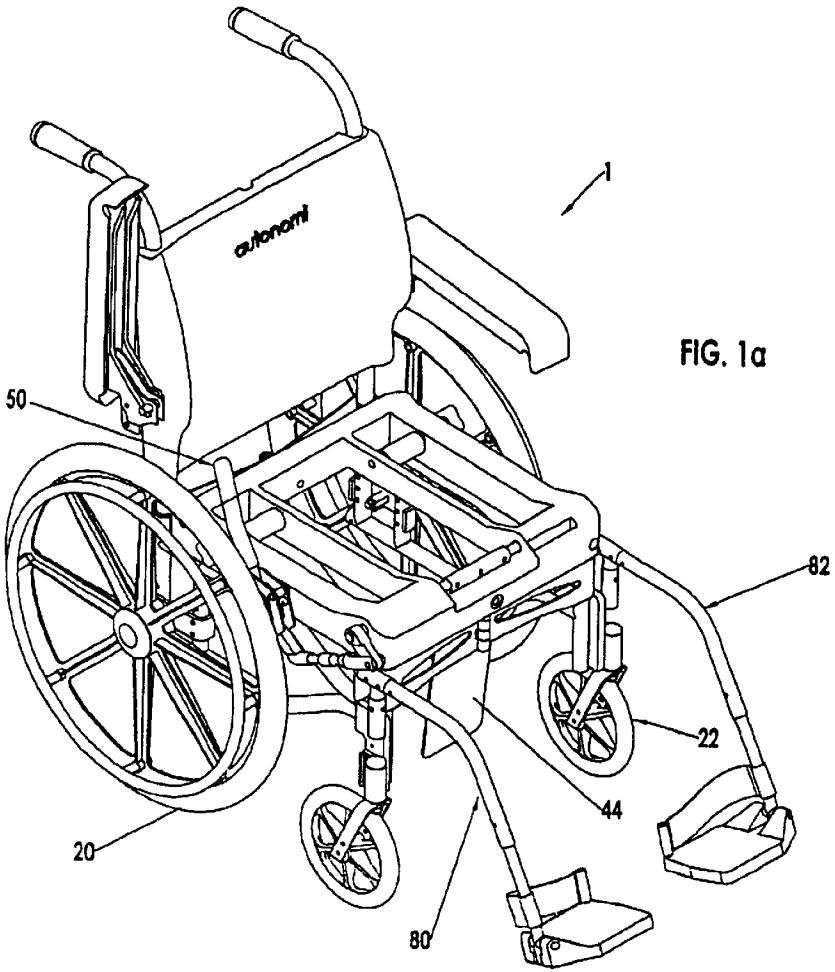
FIG. 1*a* is a perspective view of a collapsible wheel chair with a center seat panel in a lowered position in accordance with the present invention.
Figure 2:
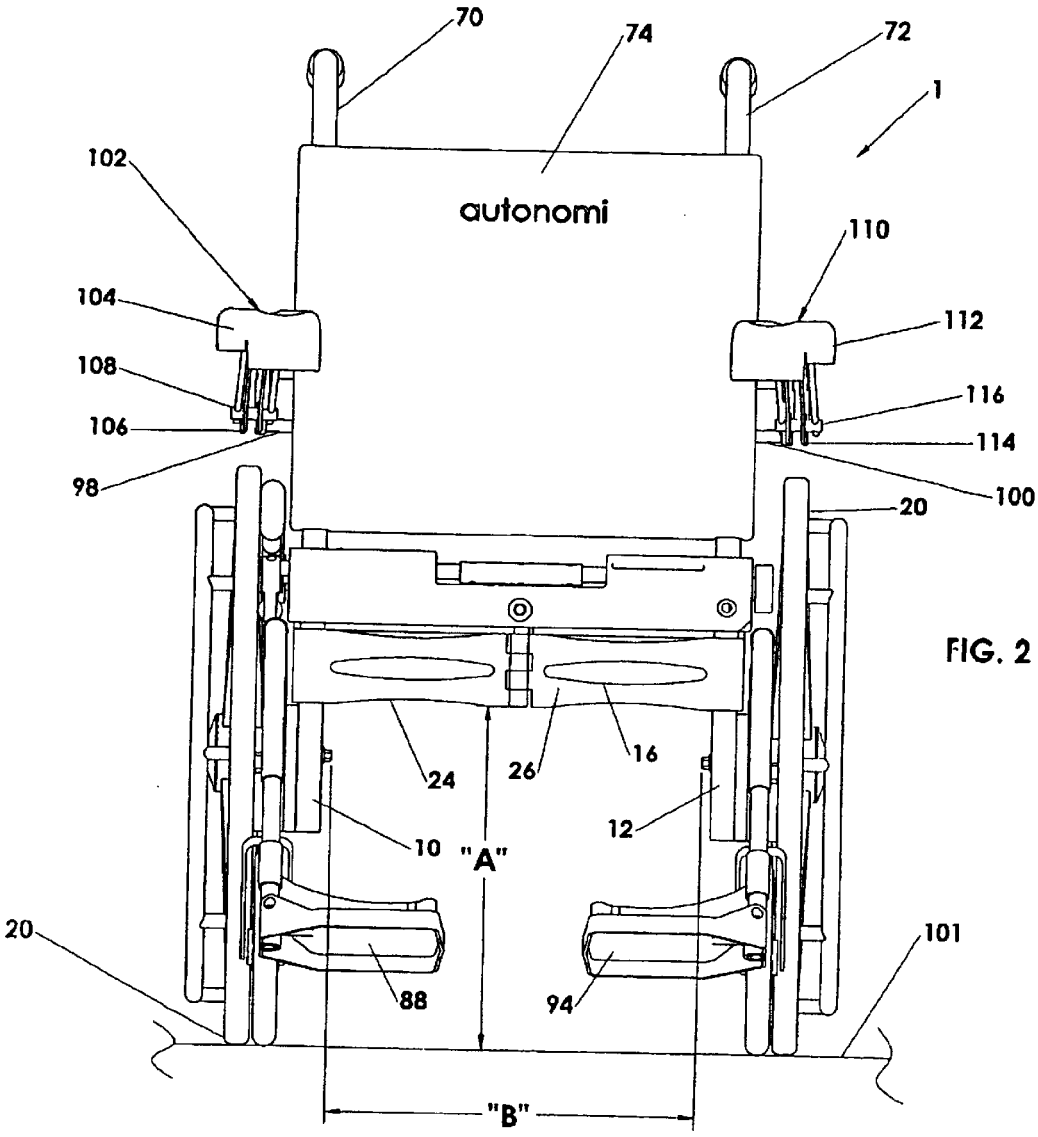
FIG. 2 is a front view of a collapsible wheel chair in accordance with the present invention.
Figure 3:
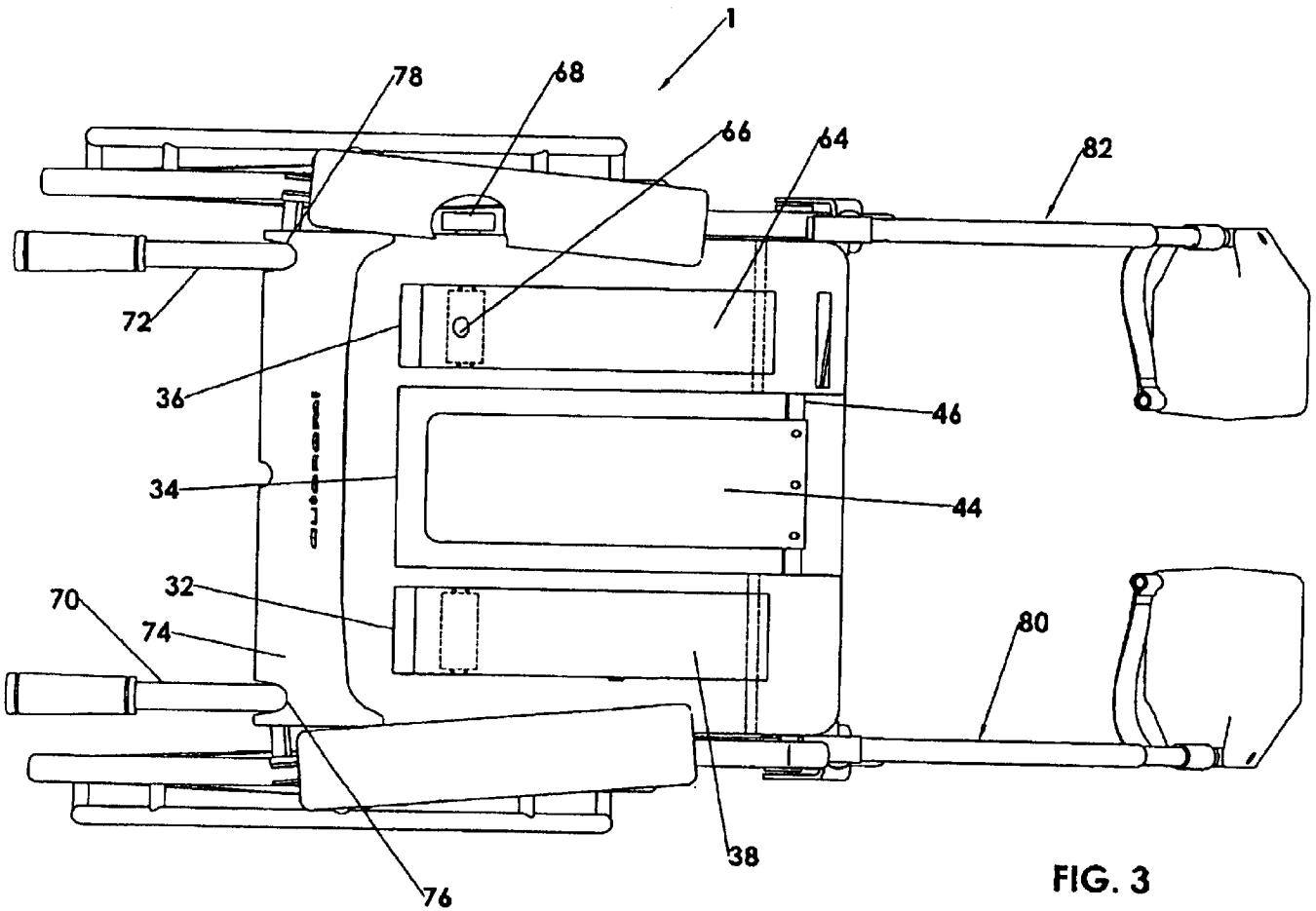
FIG. 3 is a top view of a collapsible wheel chair in accordance with the present invention.
Figure 4:
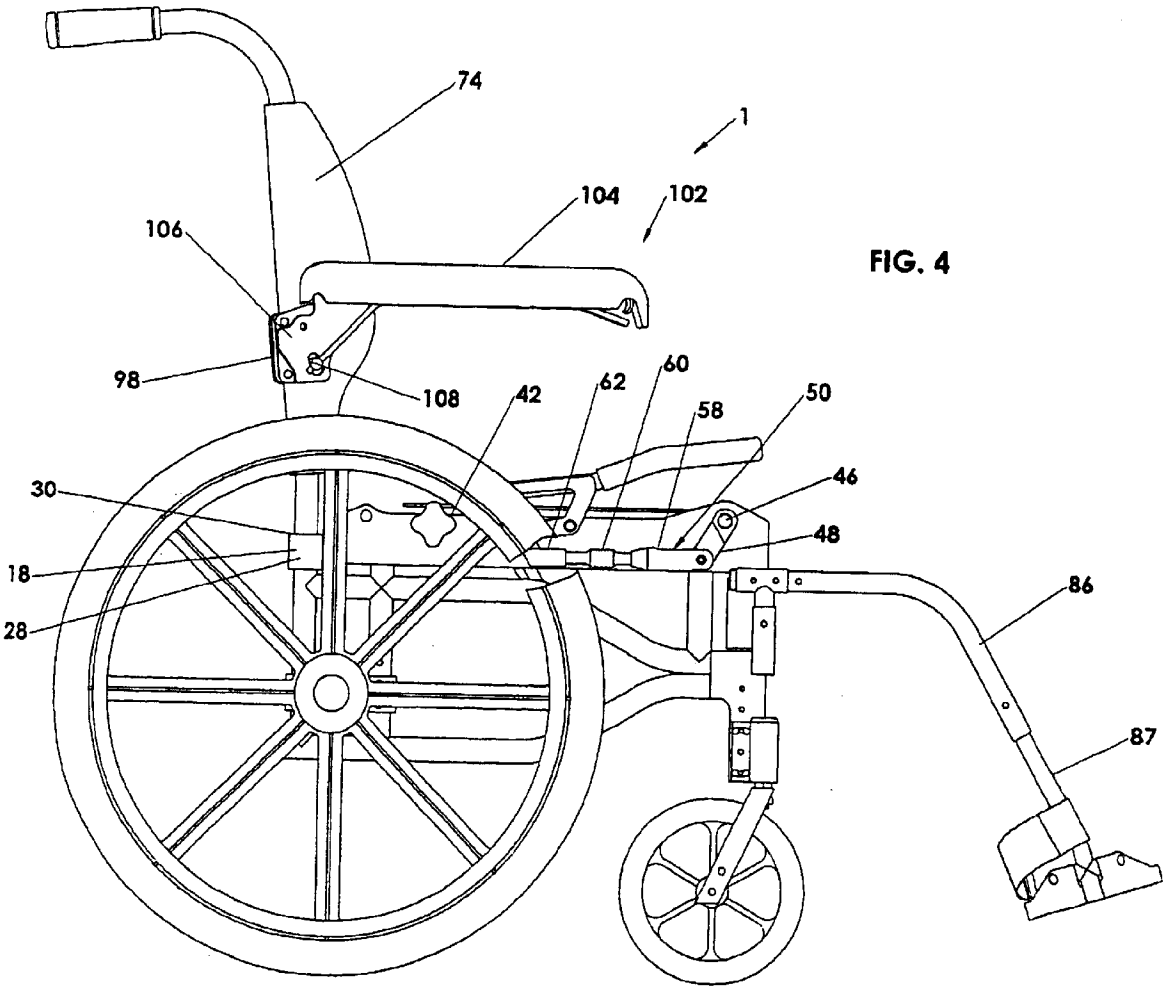
FIG. 4 is a side view of a collapsible wheel chair in accordance with the present invention.

With reference to FIG. 1*a*, the center seat panel 44 is in a dropped position when the handle 50 is in a raised position. The center seat panel 44 is in a support position when the handle 50 is in a lowered position. The collapsible wheel chair 1 has sufficient clearance to allow thereof to be rolled over most toilets. The dimension "A" from a bottom of the first pivoting support member 16 to a support surface 101 is greater than the height of most toilets. The dimension "B" of the inside of the collapsible wheel chair 1 is greater than the width of a most toilets. The dropped position of the center seat panel 44 allows a person in the collapsible wheel chair 1 to utilize the toilet, while remaining seated.

A second seat panel 64 is pivotally retained in the second seat opening 36 at a front thereof. The height of the rear of the second seat panel 64 is controlled by rotation of a second cam roller 66 pivotally retained in a rear of the second seat opening 68. The second cam roller 66 is rotated by a second knob 68 or by a motor. Preferably, a first seat pad is secured to the first seat panel 38; a center seat pad is secured to the center seat panel 40; and a second seat pad is secured to the second seat panel 64. A first handle extension 70 extends upward from the first side frame member 10 and a second handle extension extends 72 upward from the second side frame member 12. The collapsible wheel chair 1 and a noncollapsible wheel chair may only include the center seat panel 40.

Preferably, one end of a resilient seat back 74 includes a first slot 76 and a second slot 78. The first slot 76 is disposed on a first end of the resilient seat back 74 and the second slot 78 is disposed on a second end of the resilient seat back 74. The first slot 76 is sized to firmly receive the first handle extension 70 and the second slot 78 is sized to firmly receive the second handle extension 72. The resilient seat back 74 may also be secured to the first and second handle extension with any suitable fastening method.

One of the first pair of wheels 20 is pivotally retained by the first side frame member 10 at a rear thereof and the other one of the first pair of wheels 20 is pivotally retained by the second side frame member 12 at a rear thereof. Each one of the second pair of wheels 22 includes a yoke 76 and a second wheel 78. One end of the yoke 76 pivotally retains the second wheel 78 and the other end of the yoke 76 is pivotally retained by the side frame members 10, 12 at a front thereof. A first foot rest assembly 80 extends from a front of the first side frame member 10 and a second foot rest assembly extends 82 from a front of the second side frame member.

The first foot rest assembly 80 preferably includes a first rest extension rod 86, a first foot rest 88 and a first foot support 90. The first rest extension rod 86 is attached to a front of the first side frame member 10. A first telescoping rod 87 preferably extends from an end of the first rest extension rod 86. The first telescoping rod 87 is axially retained in the first rest extension rod 86 with a first detent device 89 or the like. The first foot rest 88 is pivotally attached to an end of the first telescoping rod 87 and the first foot support 90 is pivotally attached to the first telescoping rod 87 above the first foot rest 88. The pivoting range of the first foot rest 88 and the first foot support 90 are limited to provide support for the first foot.

The second foot rest assembly 82 preferably includes a second rest extension rod 92, a second foot rest 94 and a second foot support 96. The second rest extension rod 92 is attached to a front of the second side frame member 12. A second telescoping rod 93 preferably extends from an end of the second rest extension rod 92. The second telescoping rod 93 is axially retained in the second rest extension rod 92 with a second detent device 95 or the like. The second foot rest 94 is pivotally attached to an end of the second telescoping rod 93 and the second foot support 96 is pivotally attached to the second telescoping rod 93 above the second foot rest 94. The pivoting range of the second foot rest 94 and the first foot support 96 are limited to provide support for the second foot.

A first arm rest base 98 extends from the first handle extension 70 and a second arm rest base 100 extends from the second handle extension 72. A first arm rest 102 includes a first arm support 104 and at least one first pivoting plate 106. The at least one first pivoting plate 106 extends from an end of the first arm support 102. The at least one first pivoting plate 106 is pivotally retained by the first arm rest base 98 with a first pivot rod 108. A second arm rest 110 includes a second arm support 112 and at least one second pivoting plate 114. The at least one second pivoting plate 114 extends from an end of the second arm support 112. The at least one second pivoting plate 114 is pivotally retained by the second arm rest base 100 with a second pivot rod 116.

Figure 6:
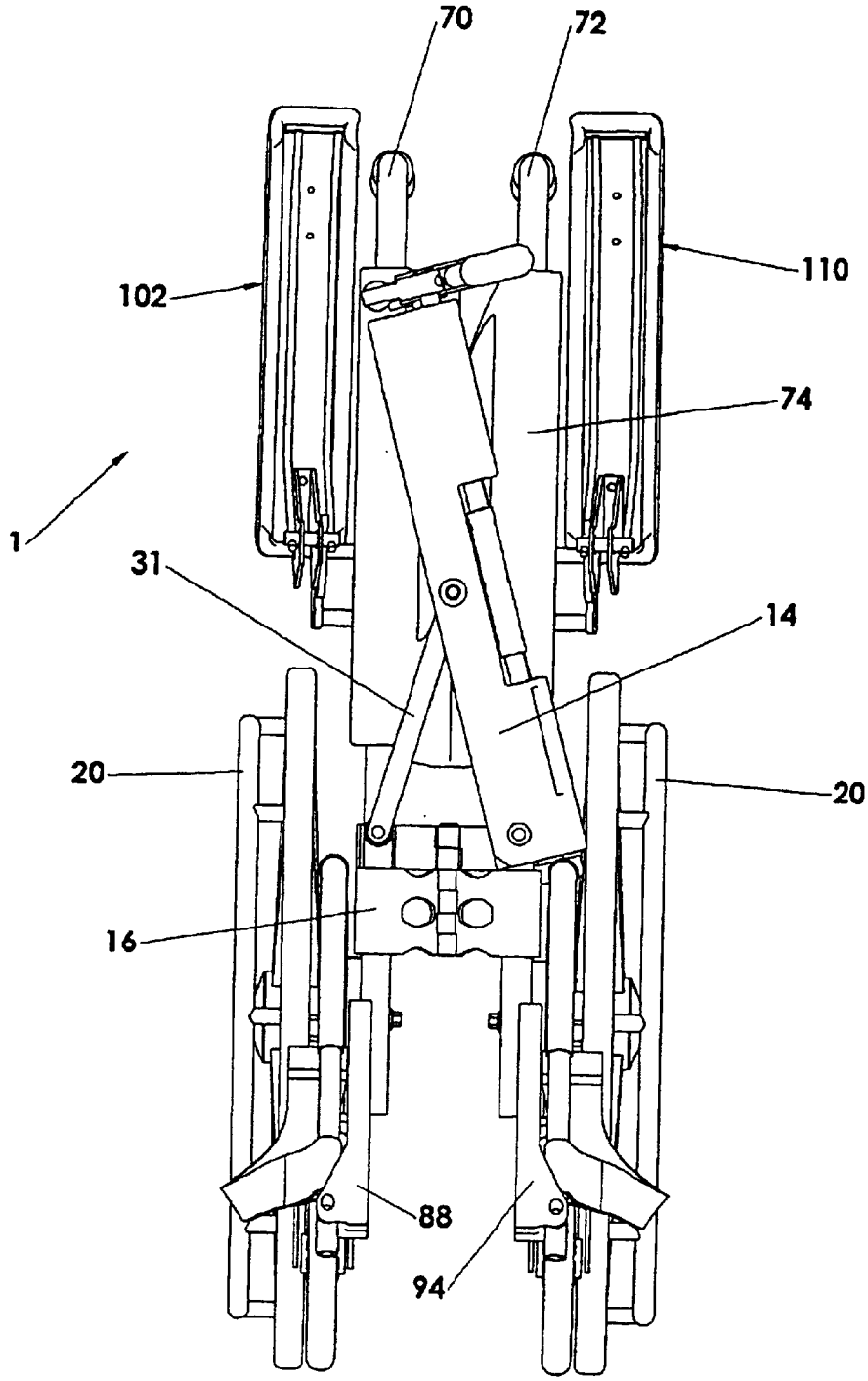
FIG. 6 is a front view of a collapsible wheel chair in a collapsed orientation in accordance with the present invention.
Figure 7:
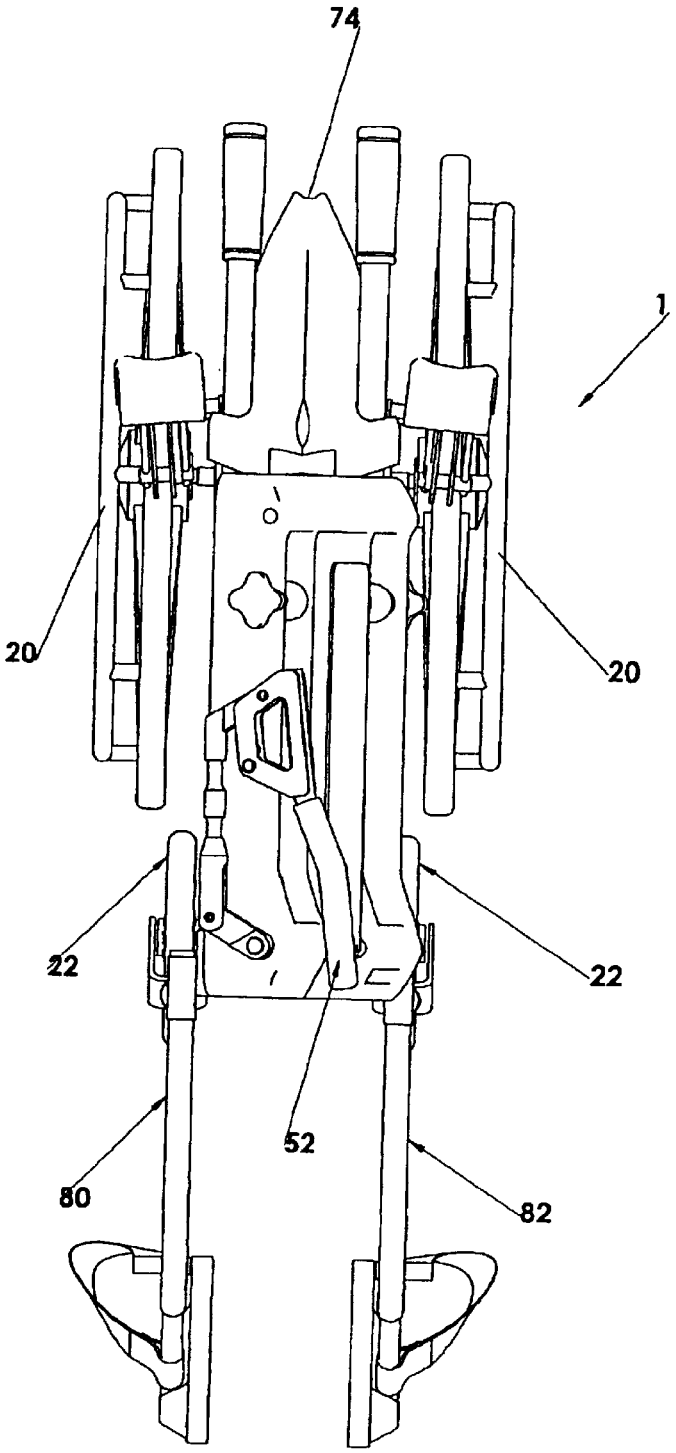
FIG. 7 is a top view of a collapsible wheel chair in a collapsed orientation in accordance with the present invention.
Figure 8:
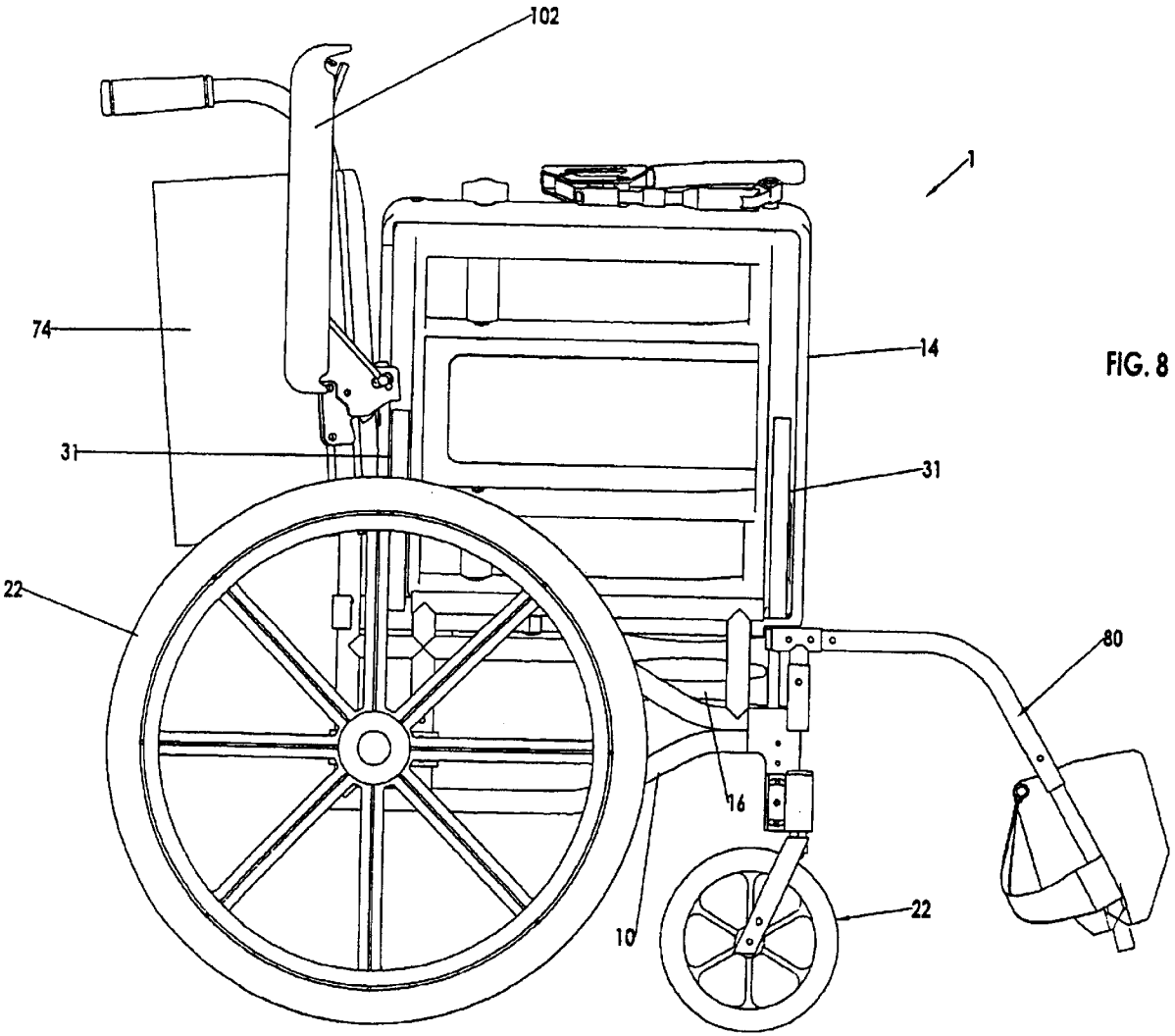
FIG. 8 is a side view of a collapsible wheel chair in a collapsed orientation in accordance with the present invention.

With reference to FIGS. 6–8, a width of the collapsible wheel chair 1 may be decreased for storage. Before the collapsible wheel chair 1 may be collapsed, the following operations are preferably implemented. The first arm rest 102 and the second arm rest 110 are swung upward. The first foot rest 88, the first foot support 90, the second foot rest 94 and the second foot support 96 are pivoted outward. Placing the collapsible wheel chair 1 in a collapsed orientation is implemented by lifting the nonpivoting end of the seat frame 14 upward, which causes the first side frame member 10 to move toward the second side frame member 12.

The collapsible wheel chair 1 may be made converted into a noncollapsible wheel chair by replacing the first pivoting support member 16 and the second pivoting support member 18 with a first rigid support member and a second rigid support member or any other suitable support structure. The collapsible wheel chair 1 and noncollapsible wheel chair are preferably rolled with the first and second pairs of wheels, but rolling methods may also be used.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of providing access to a toilet with a collapsible wheel chair, comprising the steps of:

providing a first side frame member and a second side frame member;

attaching pivotally a seat frame to one of said side frame members;

providing a first pivoting support member and a second pivoting support member, spacing said first and second side frame members from each other by pivotally attaching said first pivoting support member to a front of said first and second side frame members and pivotally attaching said second pivoting support member to a rear of said first and second side frame members, said first and second pivoting support members pivoting in a substantially horizontal plane and being solely proximate to said seat frame; and providing means for rolling said collapsible wheel chair.

2. The method of providing access to a toilet with a collapsible wheel chair of claim 1, comprising the step of:

attaching pivotally a first pair of wheels to said first and second side frame members at a rear thereof and attaching pivotally a second pair of wheels to said first and second side frame members at a front thereof for said means for rolling.

3. The method of providing access to a toilet with a collapsible wheel chair of claim 1, comprising the step of:

providing a center opening in said seat frame, a center seat panel being pivotally retained in said center opening, means for moving said center seat panel from a support position to a dropped position.

4. The method of providing access to a toilet with a collapsible wheel chair of claim 3, comprising the step of:

attaching said center seat panel to a pivot rod with a turnbuckle, moving said turnbuckle with a handle for said means for moving said center seat panel, said turnbuckle being adjustable to allow a height of said center seat panel to be adjusted.

5. The method of providing access to a toilet with a collapsible wheel chair of claim 1, comprising the step of:

providing a first opening and a second opening in said seat frame, a first seat panel being pivotally retained in said first opening, a second seat panel being pivotally retained in said second opening, means for adjusting the height of said first seat panel and means for adjusting the height of said second seat panel.

6. The method of providing access to a toilet with a collapsible wheel chair of claim 5, comprising the step of:

rotating a first cam roller for said means for adjusting the height of said first seat panel and rotating a second cam roller for said means for adjusting the height of said second seat panel.

7. The method of providing access to a toilet with a collapsible wheel chair of claim 1, comprising the step of:

attaching a first foot rest assembly to said first side support member and attaching a second foot rest assembly to said second side support member.

8. The method of providing access to a toilet with a collapsible wheel chair of claim 1, comprising the step of:

extending a first handle extension from said first side frame member, extending a second handle extension from said second side frame member, attaching a resilient seat back to said first and second handle extensions.

9. The method of providing access to a toilet with a collapsible wheel chair of claim 1, comprising the step of:

attaching pivotally a first arm rest to said first side frame member and attaching pivotally a second arm rest to said second side frame.

10. A method of providing access to a toilet with a wheel chair, comprising the steps of:

providing a first side frame member and a second side frame member;

spacing said first and second side frame members from each other with a support structure;

forming a seat frame on top of said side frame members, forming an opening through said seat frame, a seat panel being pivotally retained in said opening with a pivot rod and a turnbuckle, moving said turnbuckle with a handle for pivoting said seat panel relative to said seat frame, said turnbuckle being adjustable to allow a rear height of said seat panel to be adjusted; and providing means for rolling said wheel chair.

11. The method of providing access to a toilet with a wheel chair of claim 10, comprising the step of:

attaching pivotally a first pair of wheels to said first and second side frame members at a rear thereof and attaching pivotally a second pair of wheels to said first and second side frame members at a front thereof for said means for rolling.

12. The method of providing access to a toilet with a wheel chair of claim 10, comprising the step of:

providing a first opening and a second opening, said opening being located between said first and second openings, a first seat panel being pivotally retained in said first opening, a second seat panel being pivotally retained in said second opening, means for adjusting the height of said first seat panel and means for adjusting the height of said second seat panel.

13. The method of providing access to a toilet with a wheel chair of claim 12, comprising the step of:

rotating a first cam roller for said means for adjusting the height of said first seat panel and rotating a second cam roller for said means for adjusting the height of said second seat panel.

14. The method of providing access to a toilet with a wheel chair of claim 10, comprising the step of:

attaching a first foot rest assembly to said first side support member and attaching a second foot rest assembly to said second side support member.

15. The method of providing access to a toilet with a wheel chair of claim 10, comprising the step of:

extending a first handle extension from said first side frame member, extending a second handle extension from said second side frame member, attaching a resilient seat back to said first and second handle extensions.

16. A method of providing access to a toilet with a wheel chair, comprising the steps of:

providing a first side frame member and a second side frame member;

spacing said first and second side frame members from each other with a support structure;

forming a seat frame on top of said side frame members, forming a first opening, a center opening and a second opening through said seat frame, a first seat panel being pivotally retained in said first opening, a center panel being pivotally retained in said center opening and a second panel being pivotally retained in said second opening, means for adjusting the height of said seat panels; and providing means for rolling said wheel chair.

17. The method of providing access to a toilet with a wheel chair of claim 16, comprising the step of:

attaching pivotally a first pair of wheels to said first and second side frame members at a rear thereof and attaching pivotally a second pair of wheels to said first and second side frame members at a front thereof for said means for rolling.

18. The method of providing access to a toilet with a wheel chair of claim 16, comprising the step of:

rotating a first cam roller for said means for adjusting the height of said first seat panel and rotating a second cam roller for said means for adjusting the height of said second seat panel.

19. The method of providing access to a toilet with a wheel chair of claim 16, comprising the step of:

attaching said center seat panel to a pivot rod with a turnbuckle, actuating said turnbuckle with a handle to move said center seat panel from a support position to a dropped position said turnbuckle being adjustable to allow a rear height of said center seat panel to be adjusted.

20. The method of providing access to a toilet with a wheel chair of claim 16, comprising the step of:

extending a first handle extension from said first side frame member, extending a second handle extension from said second side frame member, attaching a resilient seat back to said first and second handle extensions.

* * * * *